US007882654B1

(12) United States Patent
Marcum et al.

(10) Patent No.: US 7,882,654 B1
(45) Date of Patent: Feb. 8, 2011

(54) ACCESSORY MOUNT FOR A FIREARM

(75) Inventors: Bryan T. Marcum, Georgetown, KY (US); David L. Barnett, Paris, KY (US)

(73) Assignee: Elzetta Design, LLC, Lexington, KY (US)

( * ) Notice: Subject to any disclaimer, the term of this patent is extended or adjusted under 35 U.S.C. 154(b) by 320 days.

(21) Appl. No.: 12/171,569

(22) Filed: Jul. 11, 2008

Related U.S. Application Data

(60) Provisional application No. 60/959,386, filed on Jul. 14, 2007.

(51) Int. Cl.
*F41G 1/00* (2006.01)
*F41G 1/35* (2006.01)

(52) U.S. Cl. ..... 42/90; 42/146

(58) Field of Classification Search ..... 42/90, 42/146

See application file for complete search history.

(56) References Cited

U.S. PATENT DOCUMENTS

| | | | | | |
|---|---|---|---|---|---|
| 824,837 | A * | 7/1906 | Alden | 248/223.41 |
| 894,306 | A * | 7/1908 | Wright | 356/247 |
| 1,029,951 | A * | 6/1912 | Seely | 362/114 |
| 1,993,979 | A * | 3/1935 | Reed | 362/113 |
| 2,385,649 | A * | 9/1945 | Prideaux | 42/132 |
| 2,546,242 | A * | 3/1951 | Stinson | 42/146 |
| 3,739,167 | A * | 6/1973 | Avery | 362/157 |
| 5,198,600 | A * | 3/1993 | E'Nama | 42/90 |
| 5,704,155 | A * | 1/1998 | Primeau, IV | 42/114 |
| 5,913,669 | A * | 6/1999 | Hansen et al. | 42/146 |
| 6,854,206 | B2 | 2/2005 | Oz | |
| 2007/0044365 | A1 * | 3/2007 | Deken | 42/146 |

OTHER PUBLICATIONS

Command Arms Accessories, Laser & Light Mounts product web pages available at http://www.commandarms.com/categories.asp?cID=19.

* cited by examiner

*Primary Examiner*—Bret Hayes
(74) *Attorney, Agent, or Firm*—Stites & Harbison, PLLC; David W. Nagle, Jr.

(57) ABSTRACT

An accessory mount for a firearm that includes a barrel and a front sight located on the barrel comprises: a first section adapted to engage a first side of the firearm at the front sight and including a boss that extends into and is received in an aperture defined by and through the front sight; a second section adapted to engage a second side of the firearm at the front sight and including a boss that extends into and is received in the aperture defined by and through the front sight; and one or more fasteners that secure the first and second sections to one another; wherein the first and second sections collectively define a substantially cylindrical channel adapted to receive and secure an accessory below the barrel of the firearm.

17 Claims, 8 Drawing Sheets

ACCESSORY MOUNT FOR A FIREARM

CROSS-REFERENCE TO RELATED APPLICATIONS

The present application claims priority to U.S. Provisional Patent Application Ser. No. 60/959,386 filed on Jul. 14, 2007, the entire disclosure of which is incorporated herein by reference.

BACKGROUND OF THE INVENTION

In recent years, the increasing complexity of tactical operations and gear has generated a need for various accessories that are mounted to a firearm, including, for example, flashlights, scopes, laser sights, etc. Consequently, various mounts and mounting systems have been developed for securing such accessories to a firearm. For example, various rail systems are known in the art for securing accessories to a firearm. In such rail systems, rails or tracks are fixed to the barrel or stock of the rifle, with the accessories then being mounted to the rails or tracks. However, such rail systems can add significant weight to the firearm and also require multiple and/or complex fasteners that can add potential failure points to the firearm. In addition, since rails are often mounted to the hand guard (or hand guard replacement) of the rifle, accessories mounted to these rails must be zeroed often. Specifically, the alignment of the accessory relative to the barrel may change slightly during firing of the firearm or if the firearm receives a shock, such as when it is dropped or bumps against an object.

Accordingly, there remains a need for an accessory mount that does not require complex rail systems, while still providing for secure mounting of an accessory to a firearm.

SUMMARY OF THE INVENTION

The present invention is an accessory mount for a firearm, and, more particularly, an accessory mount that engages the front sight of the firearm.

An exemplary accessory mount made in accordance with the present invention is secured to a firearm that includes a barrel with a the front sight positioned near the front end of the barrel. The front sight has a generally trapezoidal shape and defines an aperture therethrough above the gas-tube cross bar that has a corresponding, generally trapezoidal shape. The exemplary accessory mount is comprised of two sections: a first section adapted to engage a first side of the firearm at the front sight, and a second section adapted to engage a second side of the firearm at the front sight. The first section has an upper boss that extends into and is received in the aperture defined by and through the front sight. Similarly, the second section has an upper boss that extends into the aperture defined by and through the front sight.

The first section also defines a lower cavity, while the second section defines a corresponding lower cavity. These two lower cavities collectively define a substantially cylindrical channel positioned below the barrel when the first and second sections are assembled to the firearm, a channel adapted to receive and secure an accessory for the firearm at the front sight.

To secure the exemplary accessory mount to the firearm, the first section is positioned such that the upper boss of the first section extends into and is received in the aperture defined by and through the front sight. Similarly, the second section is positioned such that the upper boss of the second section extends into and is received in the aperture defined by and through the front sight. As a result, various holes defined by the first section are placed in registry with corresponding holes defined by the second section, such that screws or similar fasteners can be used to secure the first and second sections to one another.

Once so assembled, the substantially cylindrical channel that is collectively defined by the cavities of the respective first and second sections below the barrel can receive and secure an accessory for the firearm. In this regard, the wall of either the first or the second section surrounding the substantially cylindrical channel may be provided with a finger portion that is secured to the remainder of the section along the bottom edge of the section, resulting in a free distal end. Accordingly, since the accessory mount is preferably made of somewhat flexible plastic material, there is sufficient flexibility that the finger portion can be pressed inward relative to the adjacent wall portions of the section. Thus, when the accessory mount is secured to the firearm and an accessory is received in the channel, a thumb screw or similar fastener can be passed through a hole defined through the free distal end of the central finger portion and a corresponding hole defined by the other section. As such, tightening of the thumb screw will cause the finger portion to flex inward and into engagement with the accessory, thus applying sufficient frictional force to the accessory to secure the accessory in the channel.

As a further refinement, because the diameter of an accessory could vary, the accessory mount may include a substantially cylindrical insert comprised of a first sizing adapter section and a second sizing adapter section, which fit within the channel defined by the cavities of the respective first and second sections of the accessory mount.

Therefore, an accessory can be secured to a firearm without the need for complex rail systems or other intermediate devices, while still providing for secure mounting of the accessory to the firearm. No removal, dismantling, or changes to the sight or any other portion of the firearm are required, nor is any professional gunsmithing required. Rather, the accessory mount can be secured to the firearm with a small number of simple fasteners.

DETAILED DESCRIPTION OF THE INVENTION

Figure 1:
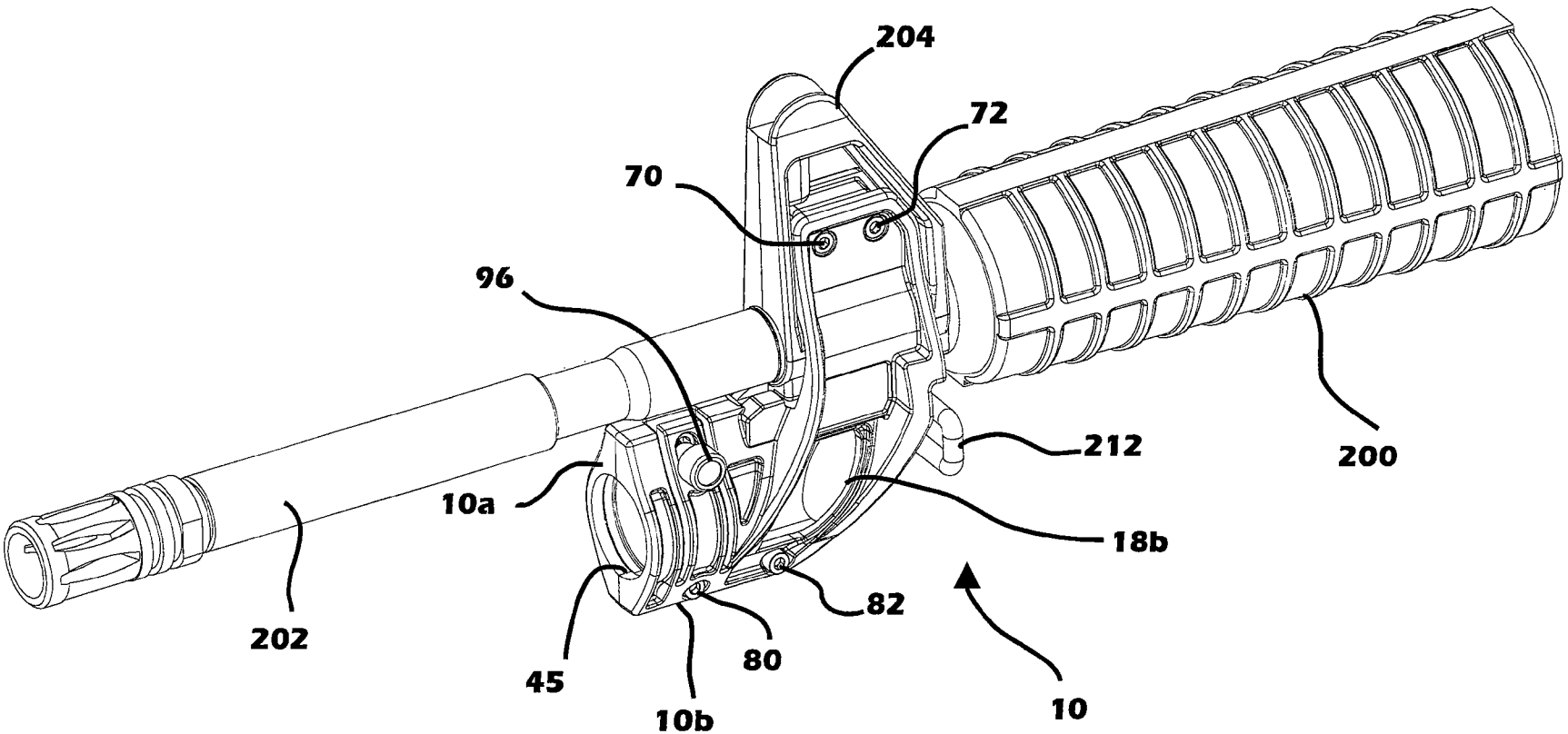
FIG. 1 is a perspective view of an exemplary accessory mount made in accordance with the present invention secured to a firearm.
Figure 2:
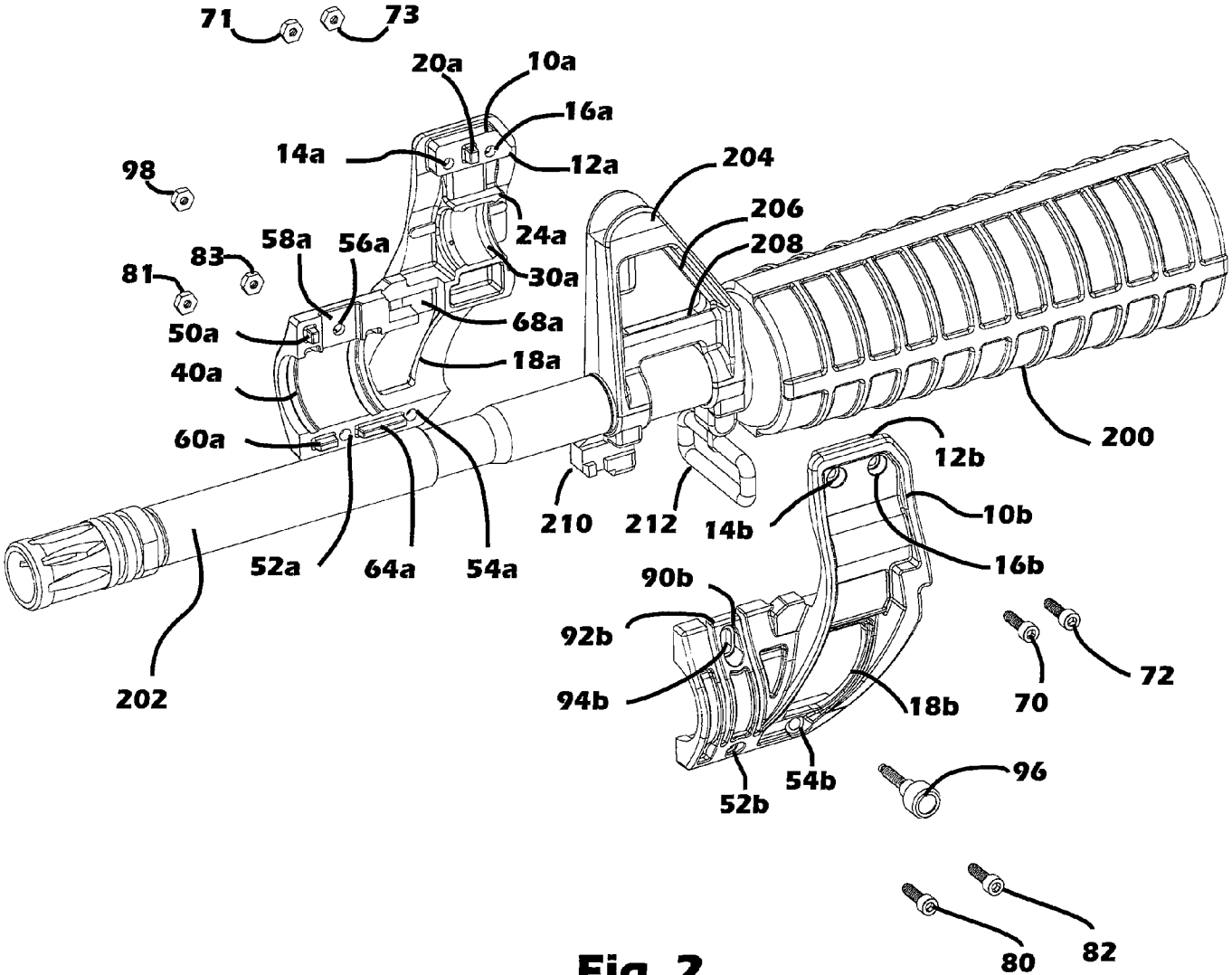
FIG. 2 is an exploded perspective view of the exemplary accessory mount of FIG. 1.

The present invention is an accessory mount for a firearm, and, more particularly, an accessory mount that engages the front sight of the firearm.

Referring now to FIGS. 1-4, an exemplary accessory mount 10 made in accordance with the present invention engages the front sight 204 of a firearm 200. In this example, and as shown in FIGS. 1-4, the exemplary accessory mount 10 is secured to a firearm 200 that is from the AR-15 family of firearms, which includes not only the AR-15 semiautomatic rifles manufactured and distributed by Colt Industries, Inc. of New York, N.Y. for civilian and sporting use, but also includes M-16 rifles and variants thereof that are used by U.S. and foreign militaries, along with similar firearms or "clones" distributed by other manufacturers. The firearm 200 includes a barrel 202, and the front sight 204 is positioned near the front end of the barrel 202. The front sight 204 has a generally trapezoidal shape and defines an aperture 206 therethrough above the gas-tube cross bar 208 that has a corresponding, generally trapezoidal shape.

Figure 3:
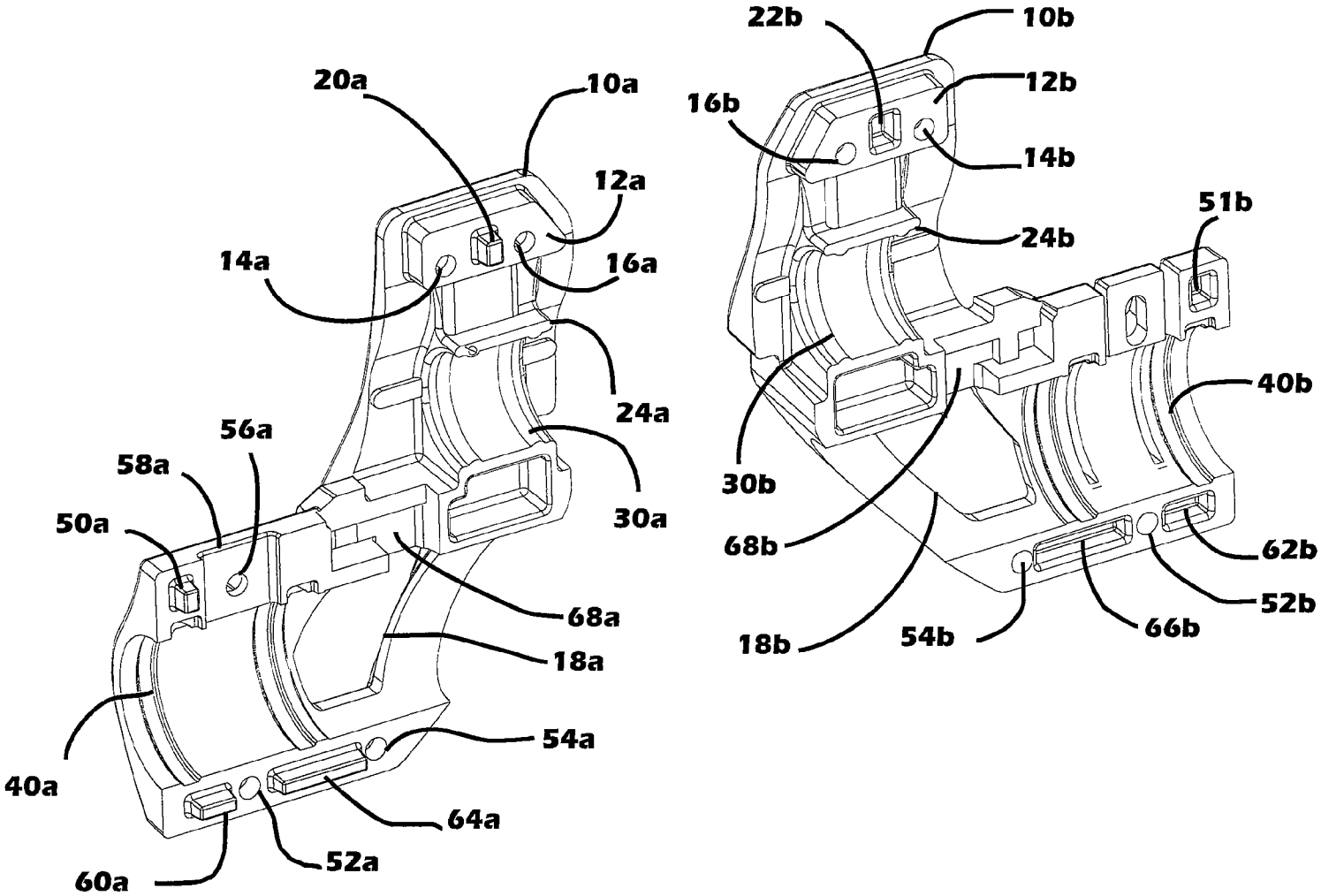
FIG. 3 is an alternate perspective view of the two sections that comprise the exemplary accessory mount of FIG. 1.

As best shown in FIG. 3, the exemplary accessory mount 10 is comprised of two sections: a first section 10*a* adapted to engage a first side of the firearm 200 at the front sight 204, and a second section 10*b* adapted to engage a second side of the firearm 200 at the front sight 204. The first section 10*a* has an upper boss 12*a* that extends into and is received in the aperture 206 defined by and through the front sight 204. The first section 10*a* further defines two holes 14*a*, 16*a* through the upper boss 12*a*, the importance of which is further discussed below. Similarly, the second section 10*b* has an upper boss 12*b* that extends into the aperture 206 defined by and through the front sight 204, and further defines two holes 14*b*, 16*b* through the upper boss 12*b*. Furthermore, in this exemplary embodiment and as shown in FIG. 3, the upper boss 12*a* includes an integral tab 20*a* that is designed to mate with a corresponding cavity 22*b* defined by the second section 10*b* when the first and second sections 10*a*, 10*b* are assembled together to the firearm 200, as further discussed below.

Referring still to FIG. 3, in this exemplary embodiment, the first section 10*a* further includes a lip 24*a* that, when the first section 10*a* is assembled to the firearm 200, extends into and is received in the aperture 206 defined by and through the front sight 204, engaging the gas tube cross-bar 208 along a lower boundary of the aperture 206. Similarly, the second section 10*b* further includes a lip 24*b* that, when the second section 10*b* is assembled to the firearm 200, extends into and is received in the aperture 206 defined by and through the front sight 204, engaging the gas tube cross-bar 208 along the lower boundary of the aperture 206 and abutting the lip 24*a* of the first section 10*a*. Below the lips 24*a*, 24*b* of the respective first and second sections 10*a*, 10*b* of the accessory mount 10, each section 10*a*, 10*b* defines a cavity 30*a*, 30*b*. These two cavities 30*a*, 30*b* collectively define a substantially cylindrical channel that engages the barrel 202 of the firearm 200 below the front sight 204 when the first and second sections 10*a*, 10*b* are assembled to the firearm 200.

Referring still to FIG. 3, the first section 10*a* also defines a lower cavity 40*a*, while the second section 10*b* defines a corresponding lower cavity 40*b*. These two lower cavities 40*a*, 40*b* collectively define a substantially cylindrical channel positioned below the barrel 202 when the first and second sections 10*a*, 10*b* are assembled to the firearm 200, a channel adapted to receive and secure an accessory for the firearm 200, as further discussed below. Furthermore, in this exemplary embodiment, the first section 10*a* includes an integral tab 50*a* positioned above the cavity 40*a* that is designed to mate with a corresponding cavity 51*b* defined by the second section 10*b* when the first and second sections 10*a*, 10*b* are assembled together to the firearm 200. Additionally, in this exemplary embodiment, the first section 10*a* includes integral tabs 60*a*, 64*a* positioned below the cavity 40*a* that are designed to mate with corresponding cavities 62*b*, 66*b* defined by the second section 10*b* when the first and second sections 10*a*, 10*b* are assembled together to the firearm 200. Finally, the first section 10*a* defines two holes 52*a*, 54*a* along its lower edge and below the cavity 40*a*, while the second section 10*b* defines two corresponding holes 52*b*, 54*b* along its lower edge and below the cavity 40*b*.

As a further refinement, and as also best shown in FIG. 3, the first section 10*a* also defines a shaped cavity 68*a* that is positioned just below the barrel 202 of the firearm 200 when assembled to the firearm 200, while the second section 10*b* defines a corresponding shaped cavity 68*b*. These shaped cavities 68*a*, 68*b* cooperate to create a void so that the accessory mount 10 can be positioned over the bayonet lug 210 that is common on firearms from the AR-15 family of firearms.

To secure the exemplary accessory mount 10 to the firearm 200, the first section 10*a* is positioned such that the upper boss 12*a* of the first section 10*a* extends into and is received in the aperture 206 defined by and through the front sight 204. Similarly, the second section 10*b* is positioned such that the upper boss 12*b* of the second section 10*b* extends into and is received in the aperture 206 defined by and through the front sight 204. As a result, the hole 14*a* defined by the first section 10*a* is in registry with the hole 14*b* defined by the second section 10*b*, such that a screw 70 or similar fastener can be passed through the holes 14*a*, 14*b* and secured by a nut 71. Similarly, the hole 16*a* defined by the first section 10*a* is in registry with the hole 16*b* defined by the second section 10*b*, such that a screw 72 or similar fastener can be passed through the holes 16*a*, 16*b* and secured by a nut 73. In this regard, although not clearly shown in the Figures, the nuts 71, 73 (along with the nuts 81, 83, 98 described below) preferably have hexagonal heads and are each received in a respective exterior cavity defined by the first section 10*a* that has a corresponding hexagonal shape, thus preventing rotation of the nuts 71, 73 during assembly. As mentioned above, when assembled in this manner, the integral tab 20*a* of the first section 10*a* mates with the corresponding cavity 22*b* defined by the second section 10*b*.

Along the lower edge of the accessory mount 10, the hole 52*a* defined by the first section 10*a* is in registry with the hole 52*b* defined by the second section 10*b*, such that a screw 80 or similar fastener can be passed through the holes 52*a*, 52*b* and secured by a nut 81. Similarly, the hole 54*a* defined by the first section 10*a* is in registry with the hole 54*b* defined by the second section 10*b*, such that a screw 82 or similar fastener can be passed through the holes 54*a*, 54*b* and secured by a nut 83. As mentioned above, when assembled in this manner, the integral tab 50*a* positioned above the cavity 40*a* of the first section 10*a* mates with a corresponding cavity 51*b* defined by the second section 10*b*, while the integral tabs 60*a*, 64*a* positioned below the cavity 40*a* of the first section 10*a* mate with corresponding cavities 62*b*, 66*b* defined by the second section 10*b*.

Returning now to FIG. 1, the substantially cylindrical channel (as generally indicated by reference numeral 45 in FIG. 1) that is collectively defined by the cavities 40*a*, 40*b* of the respective first and second sections 10*a*, 10*b* is adapted to receive and secure an accessory for the firearm 200, such as a flashlight (not shown). In this regard, in this exemplary embodiment, the wall of the second section 10*b* surrounding the substantially cylindrical channel 45 includes a central finger portion 90*b* that is secured to the remainder of the second section 10*b* along the bottom edge of the second section 10*b*, resulting in a free distal end 92*b*. Accordingly, since the accessory mount 10 is preferably made of a glass-filled nylon material (such as Ultramid® 1503-2, which is manufactured and distributed by BASF Aktiengesellschaft of Ludwigshafen, Germany), or a similar plastic material, there is sufficient flexibility that the central finger portion 90*b* can be pressed inward relative to the adjacent wall portions of the second section 10*b*. Thus, when the accessory mount 10 is secured to the firearm 200 and an accessory (not shown) is received in the channel 45, a thumb screw 96 or similar fastener can be passed through a hole 94*b* defined through the free distal end 92*b* of the central finger portion 90*b* and a corresponding hole 56*a* defined by the first section 10*a*, where it is then secured by a nut 98. As such, tightening of the thumb screw 96 will cause the central finger portion 90*b* to flex inward toward the first section 10*a* and into a cutout section 58*a* defined in the wall of the first section 10*a*, pressing the central finger portion 90*b* into engagement with the accessory and applying sufficient frictional force to the accessory to secure the accessory in the channel 45.

Figure 4:
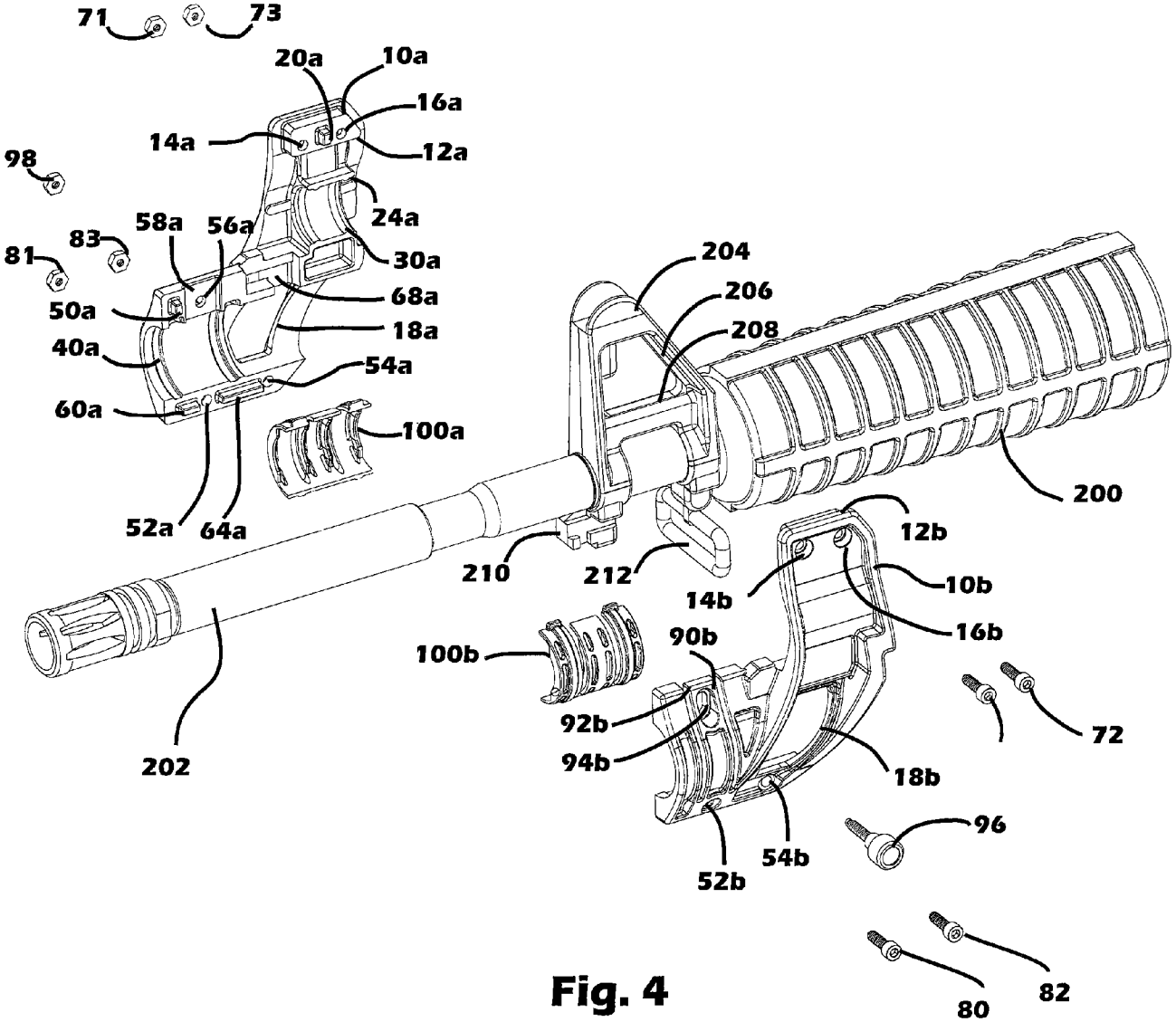
FIG. 4 is a perspective view of an alternate exemplary accessory mount made in accordance with the present invention secured to a firearm and including first and second sizing adapter sections.
Figure 5:
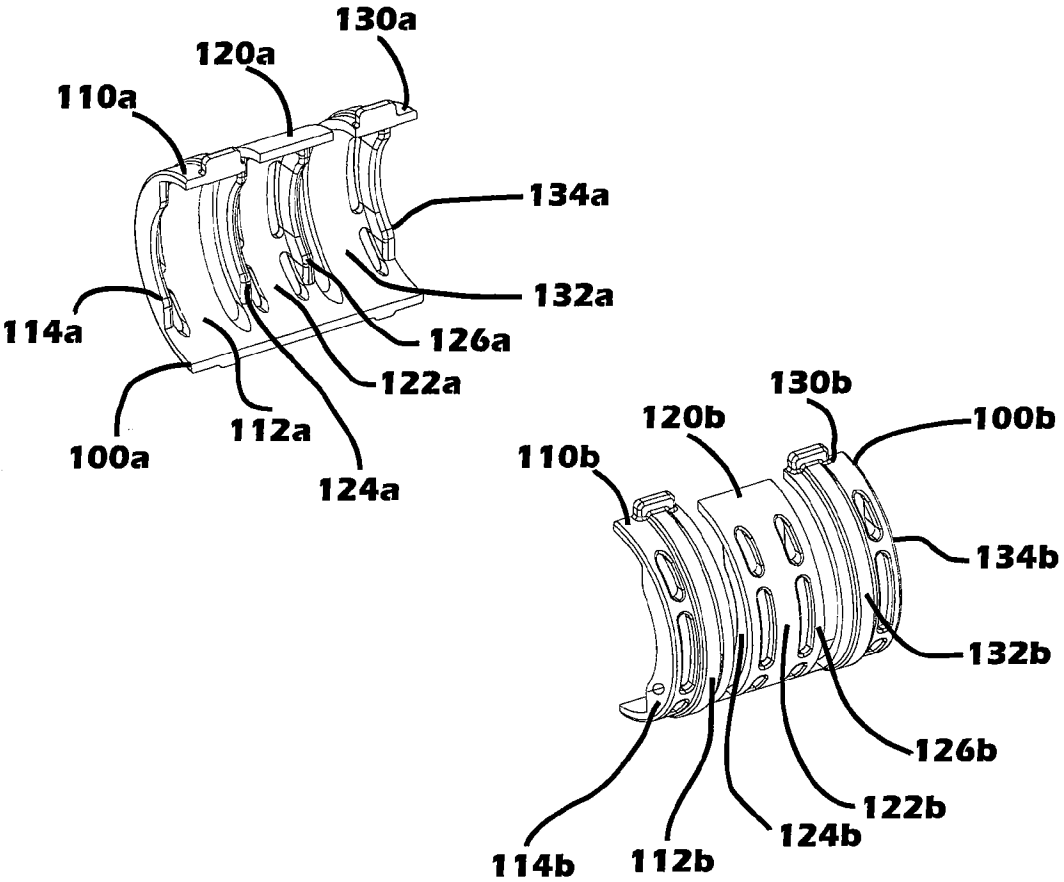
FIG. 5 is a perspective view of the first and second sizing adapter sections of FIG. 4.

Referring now to FIGS. 4 and 5, because the diameter of a flashlight or other accessory could vary, as a further refinement, the accessory mount 10 of the present invention may include a means for effectively changing the diameter of the substantially cylindrical channel 45 (shown in FIG. 1) that is collectively defined by the cavities 40*a*, 40*b* of the respective first and second sections 10*a*, 10*b*, while ensuring that accessory is properly aligned within the channel 45. Specifically, in this alternate embodiment, the accessory mount 10 further includes a first sizing adapter section 100*a* and a second sizing adapter section 100*b*, which collectively form a substantially cylindrical insert that fits within the channel 45 (shown in FIG. 1) defined by the cavities 40*a*, 40*b* of the respective first and second sections 10*a*, 10*b* of the accessory mount 10.

Referring now to FIG. 5, the first sizing adapter section 100*a* includes three discrete ribs 110*a*, 120*a*, 130*a*, which are connected to one another along the lower edge of the sizing adapter section 100*a*. The first rib 110*a* includes a base portion 112*a* with an inwardly extending side wall portion 114*a* connected to the outer lateral edge of the base portion 112*a*. The second rib 120*a* includes a base portion 122*a* with a pair of inwardly extending side wall portions 124*a*, 126*a*, one connected to each lateral edge of the base portion 122*a*. Finally, the third rib 130*a* includes a base portion 132*a* with an inwardly extending side wall portion 134*a* connected to the lateral edge of the base portion 132*a*.

Similarly, the second sizing adapter section 100*b* is essentially a mirror image of the first sizing adapter section 100*a*, including three discrete ribs 110*b*, 120*b*, 130*b*, which are connected to one another along the lower edge of the sizing adapter section 100*b*. The first rib 110*b* includes a base portion 112*b* with an inwardly extending side wall portion 114*b* connected to the outer lateral edge of the base portion 112*b*. The second rib 120*b* includes a base portion 122*b* with a pair of inwardly extending side wall portions 124*b*, 126*b*, one connected to each lateral edge of the base portion 122*b*. Finally, the third rib 130*b* includes a base portion 132*b* with an inwardly extending side wall portion 134*b* connected to the lateral edge of the base portion 132*b*.

Figure 6:
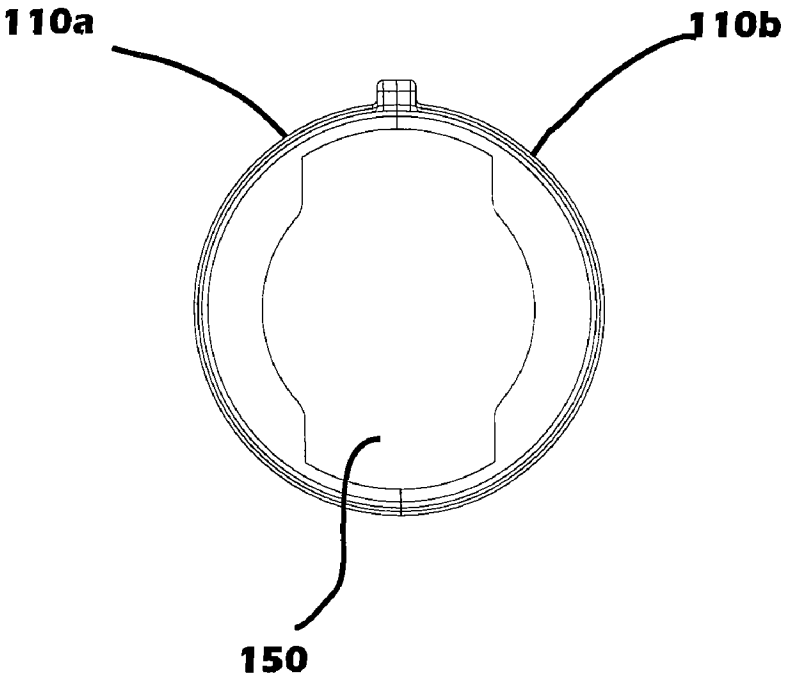
FIG. 6 is an end view of the first and second sizing adapter sections of FIG. 4 assembled to one another.

As best shown in FIG. 6, when the sizing adapter sections 100*a*, 100*b* are fit together within the channel 45 defined by the cavities 40*a*, 40*b* of the respective first and second sections 10*a*, 10*b* of the accessory mount 10, an inner, substantially cylindrical channel 150 is formed for receiving and securing an accessory for the firearm 200. The channel 150 has a smaller diameter than that of the channel 45 (shown in FIG. 1) defined by the cavities 40*a*, 40*b* of the respective first and second sections 10*a*, 10*b*. For example, in this exemplary embodiment, the diameter of the channel 45 (shown in FIG. 1) is approximately one inch, while the diameter of the channel 150 is approximately three-quarters of an inch. Accordingly, by using the sizing adapter sections 100*a*, 100*b*, the accessory mount 10 can receive and secure accessories with a smaller diameter.

Figure 7:
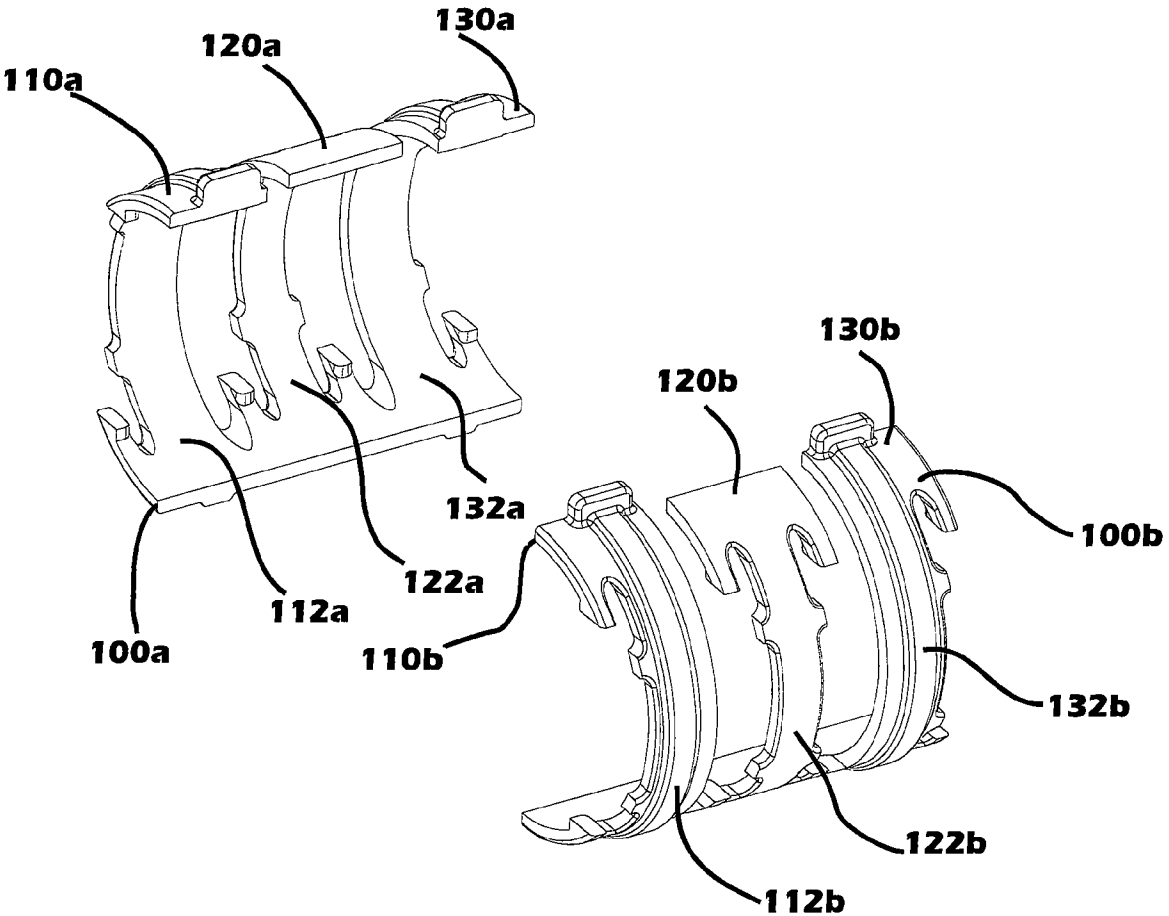
FIG. 7 is a perspective view of the first and second sizing adapter sections similar to that of FIG. 5, but with the inwardly extending side wall portions from each of the first and second sizing adapter sections removed.
Figure 8:
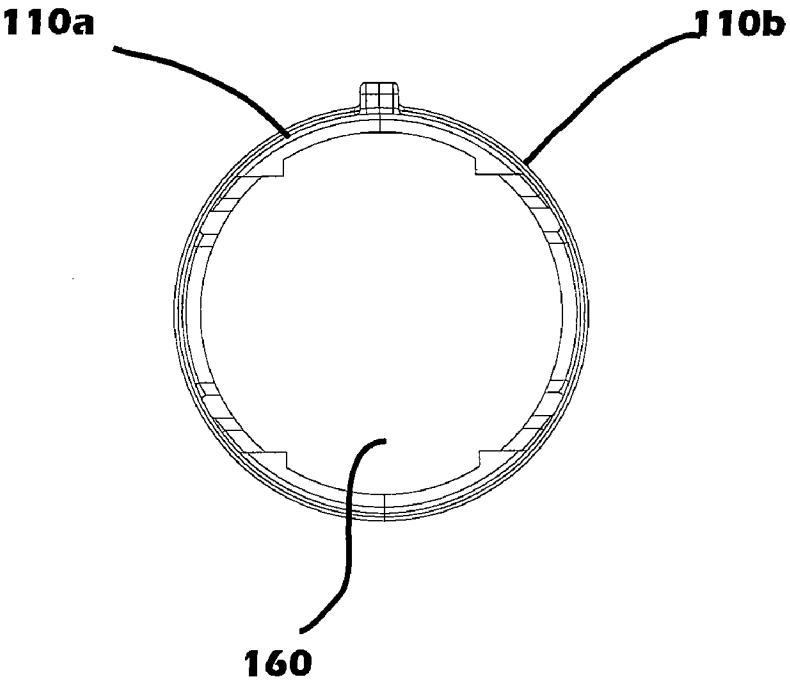
FIG. 8 is an end view of the first and second sizing adapter sections similar to that of FIG. 6, but with the inwardly extending side wall portions from each of the first and second sizing adapter sections removed.

Furthermore, to the extent that an accessory has an intermediate diameter, the sizing adapter sections 100*a*, 100*b* can be further adjusted by cutting and removing the four inwardly extending side wall portions 114*a*, 124*a*, 126*a*, 134*a*, 114*b*, 124*b*, 126*b*, 134*b* from each of the first and second sizing adapter sections 100*a*, 100*b*. As shown in FIGS. 7 and 8, this results in a substantially cylindrical channel 160 with a diameter between that of the channel 150 (shown in FIG. 6) and the channel 45 (shown in FIG. 1).

Therefore, in accordance with the teachings of the present invention, an accessory can be secured to a firearm without the need for complex rail systems or other intermediate devices, while still providing for secure mounting of the accessory to the firearm. No removal, dismantling, or changes to the sight or any other portion of the firearm are required, nor is any professional gunsmithing required. Rather, the accessory mount can be secured to the firearm with a small number of simple fasteners.

Furthermore, once an accessory is secured to a firearm 200 using the accessory mount 10 of the present invention, the accessory and its on/off switch can be readily accessed while the firearm 200 remains in a ready-to-fire position as the user can simply slide his hand forward along the length of the firearm 200 to locate the accessory. In this regard, if the accessory received and secured to the firearm 200 is a flashlight (not shown) with the tail cap extending out of the rear of the accessory mount 10, the front sling swivel 212 will be located just behind the exposed tail cap of the flashlight. Thus, the user can readily activate the push-button, on-off switch of the flashlight by rotating and pressing the front sling swivel 212 into engagement with the push-button, on-off switch. If the accessory received and secured to the firearm 200 is a flashlight, but the tail cap is recessed into the interior of the accessory mount 10, the tail cap can still be accessed and rotated through the large side openings 18*a*, 18*b* defined through the respective first and second sections 10*a*, 10*b*.

One of ordinary skill in the art will recognize that additional embodiments are also possible without departing from the teachings of the present invention or the scope of the claims which follow. This detailed description, and particularly the specific details of the exemplary embodiments disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An accessory mount for a firearm that includes a barrel and a front sight located on the barrel, comprising:

a first section adapted to engage a first side of the firearm at the front sight and including a boss that extends into and is received in an aperture defined by and through the front sight;

a second section adapted to engage a second side of the firearm at the front sight and including a boss that extends into and is received in the aperture defined by and through the front sight; and one or more fasteners that secure the first and second sections to one another;

wherein the first and second sections collectively define a substantially cylindrical and enclosed channel that is positioned below and substantially parallel to the barrel of the firearm, and wherein the substantially cylindrical and enclosed channel is adapted to receive and secure an accessory.

2. The accessory mount as recited in claim 1, wherein the first and second sections collectively define a second substantially cylindrical channel that engages the barrel of the firearm below the front sight.

3. The accessory mount as recited in claim 1, wherein the aperture defined by and through the front sight has a generally trapezoidal shape, wherein the boss of the first section that extends into the aperture defined by and through the front sight has a corresponding trapezoidal shape, and wherein the boss of the second section that extends into the aperture defined by and through the front sight also has a corresponding trapezoidal shape.

4. The accessory mount as recited in claim 3, wherein the first section further includes a lip that extends into the aperture defined by and through the front sight and engages a gas tube cross-bar along a lower boundary of the aperture defined by and through the front sight, and wherein the second section also includes a lip that extends into the aperture defined by and through the front sight and engages the gas tube cross-bar along the lower boundary of the aperture defined by and through the front sight.

5. The accessory mount as recited in claim 1, wherein at least one of the first and second sections includes a wall portion surrounding the substantially cylindrical and enclosed channel adapted to receive and secure the accessory, and wherein the wall portion has a free distal end, such that the wall portion can be pressed inward relative to adjacent wall portions and into engagement with the accessory that is received and secured in the substantially cylindrical and enclosed channel.

6. The accessory mount as recited in claim 1, and further comprising an insert that fits within the substantially cylindrical and enclosed channel defined by the first and second sections, said insert defining an inner, substantially cylindrical channel with a diameter less than that of the substantially cylindrical and enclosed channel defined by the first and second sections.

7. The accessory mount as recited in claim 6, in which said insert includes a first sizing adapter section and a second sizing adapter section.

8. The accessory mount as recited in claim 7, in which each said sizing adapter section comprises multiple discrete ribs that are connected to one another along an edge of the respective sizing adapter section.

9. The accessory mount as recited in claim 8, in which each rib of each said sizing adapter section includes a base portion with one or more inwardly extending side wall portions, such that removal of the one or more inwardly extending side wall portions effectively changes the diameter of the inner, substantially cylindrical channel.

10. A combination, comprising:

a firearm that includes a barrel and a front sight located on the barrel;

an accessory for the firearm; and an accessory mount secured to the firearm at the front sight, the accessory mount including a first section adapted to engage a first side of the firearm at the front sight, a second section adapted to engage a second side of the firearm at the front sight, and one or more fasteners that secure the first and second sections to one another, and wherein the first and second sections collectively define a substantially and enclosed cylindrical channel that (a) is positioned below and substantially parallel to the barrel of the firearm and (b) receives and secures the accessory below the barrel of the firearm.

11. The combination as recited in claim 10, wherein at least one of the first and second sections includes a wall portion surrounding the substantially cylindrical and enclosed channel adapted to receive and secure the accessory, and wherein the wall portion has a free distal end, such that the wall portion can be pressed inward relative to adjacent wall portions and into engagement with the accessory.

12. The combination as recited in claim 10, and further comprising an insert that fits within the substantially cylindrical and enclosed channel defined by the first and second sections, said insert defining an inner, substantially cylindrical channel with a diameter less than that of the substantially cylindrical and enclosed channel defined by the first and second sections.

13. The combination as recited in claim 12, in which said insert includes a first sizing adapter section and a second sizing adapter section.

14. The accessory mount as recited in claim 13, in which each said sizing adapter section comprises multiple discrete ribs that are connected to one another along a lower edge of the respective sizing adapter section.

15. The accessory mount as recited in claim 14, in which each rib of each said sizing adapter section includes a base portion with one or more inwardly extending side wall portions, such that removal of the one or more inwardly extending side wall portions effectively changes the diameter of the inner, substantially cylindrical channel.

16. An accessory mount for a firearm that includes a barrel and a front sight located on the barrel, comprising:

a first section adapted to engage a first side of the firearm at the front sight and including a boss that extends into and is received in an aperture defined by and through the front sight;

a second section adapted to engage a second side of the firearm at the front sight and including a boss that extends into and is received in the aperture defined by and through the front sight;

one or more fasteners that secure the first and second sections to one another, such that the first and second sections collectively define a substantially cylindrical channel adapted to receive and secure an accessory; and an insert that fits within the substantially cylindrical channel defined by the first and second sections, said insert defining an inner, substantially cylindrical channel with a diameter less than that of the substantially cylindrical channel defined by the first and second sections, and said insert including a first sizing adapter section and a second sizing adapter section;

wherein each said sizing adapter section comprises multiple discrete ribs that are connected to one another along an edge of the respective sizing adapter section.

17. The accessory mount as recited in claim 16, in which each rib of each said sizing adapter section includes a base portion with one or more inwardly extending side wall portions, such that removal of the one or more inwardly extending side wall portions effectively changes the diameter of the inner, substantially cylindrical channel.

* * * * *